US007156505B2

(12) United States Patent
Suzuki

(10) Patent No.: US 7,156,505 B2
(45) Date of Patent: Jan. 2, 2007

(54) DROPLET EJECTING APPARATUS

(75) Inventor: Yoshihumi Suzuki, Ena (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 15 days.

(21) Appl. No.: 10/746,216

(22) Filed: Dec. 23, 2003

(65) Prior Publication Data

US 2004/0135852 A1 Jul. 15, 2004

(30) Foreign Application Priority Data

Dec. 25, 2002 (JP) ..... 2002-373766

(51) Int. Cl.
*B41J 2/045* (2006.01)

(52) U.S. Cl. ..... 347/72; 347/68

(58) Field of Classification Search ..... 347/20, 347/68–72; 310/332, 359

See application file for complete search history.

(56) References Cited

U.S. PATENT DOCUMENTS 5,266,964 A 11/1993 Takahashi et al.
6,174,051 B1 * 1/2001 Sakaida ..... 347/72
6,739,704 B1 * 5/2004 Takahashi ..... 347/72

FOREIGN PATENT DOCUMENTS

JP 2913806 B2 4/1992
JP 3290897 B2 3/1998
JP 2000-127380 A 5/2000
JP 2000-127380 A * 9/2000

OTHER PUBLICATIONS

Yoshimura, Kotaro. Inkjet Printing Technology. Aug. 1998. Retrieved from the Internet: http://www.oki.com/en/otr/html/nf/otr-161.html vol. 64, p. 41.*

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

Since two polarizing external electrodes sandwich a portion of a sheet-stacked piezoelectric body that is located between first and second internal electrodes, that portion of the stacked piezoelectric body is polarized in a direction perpendicular to a direction in which the first and second internal electrodes are opposed to each other, when a polarizing voltage is applied to the two polarizing electrodes. Subsequently, the two polarizing electrodes are electrically connected to the second internal electrodes. Thus, the sheet-stacked piezoelectric body can be manufactured without needing to remove the polarizing electrodes. When a drive voltage is applied to the first and second internal electrodes, intermediate piezoelectric sheets of the stacked piezoelectric body are deformed in a "shear" mode, i.e., are curved toward a pressure chamber in which ink is accommodated. Since, simultaneously, an electric field parallel to the direction of polarization of the stacked piezoelectric body is produced in an outermost piezoelectric sheet of the stacked body, the outermost sheet is elongated in the direction of stacking of the piezoelectric sheets, whereby the amount of deformation of the stacked piezoelectric body toward the pressure chamber is increased.

17 Claims, 9 Drawing Sheets

DROPLET EJECTING APPARATUS

BACKGROUND OF THE INVENTION

1. Field of the Invention

The present invention relates to a droplet ejecting apparatus and in particular to such a droplet ejecting apparatus which includes a piezoelectric body that can be produced at low cost, be easily polarized, and enjoy improved deformation efficiency at a given drive voltage.

2. Discussion of Related Art

There have conventionally been known various sorts of ink jet recording heads each for use in an ink jet recording apparatus. For example, Japanese Patent No. 2913806 or its corresponding U.S. Pat. No. 5,266,964 discloses an ink jet recording head including a cavity plate having a pressure chamber in which ink is accommodated, and a sheet-stacked-type piezoelectric element fixed to the cavity plate to close the opening of the pressure chamber. In this ink jet recording head, when a drive voltage is applied to first and second internal electrodes provided in the sheet-stacked piezoelectric element that is polarized, in advance, in the direction of stacking of piezoelectric sheets thereof, an electric field is produced in the stacked piezoelectric element, in a direction perpendicular to the direction of polarization thereof, so that the piezoelectric element is deformed in a so-called shear mode. This deformation of the piezoelectric element results in changing the volume of the pressure chamber, so that a droplet of ink is ejected from a nozzle communicating with the pressure chamber.

The above-indicated document additionally discloses a method of manufacturing the stacked piezoelectric element. The disclosed method includes a polarizing step in which, first, one or more internal electrodes are printed on each of a plurality of piezoelectric ceramic green sheets, respectively, then the green sheets are stacked on each other to provide a sheet-stacked piezoelectric body, subsequently two polarizing external electrodes are formed, by, e.g., spattering, on upper and lower surfaces of the stacked piezoelectric body, respectively, and finally a polarizing voltage is applied to the two polarizing external electrodes so as to polarize the stacked piezoelectric body in the direction of stacking of the piezoelectric sheets; and a removing step in which, after the stacked piezoelectric body is polarized in the direction of stacking of the piezoelectric sheets in the polarizing step, the polarizing external electrodes are removed, by, e.g., etching, from the stacked piezoelectric body.

However, in the above-described manufacturing method, the removing step in which the polarizing external electrodes are removed by, e.g., etching from the stacked piezoelectric body, is very cumbersome and time-consuming. This leads to increasing the cost of manufacturing of the stacked piezoelectric body or element. In addition, since the sheet-stacked piezoelectric element is deformed by just producing the electric field in the direction perpendicular to the direction of polarization of the element, the element cannot enjoy a sufficiently high deformation efficiency at an appropriate drive voltage.

SUMMARY OF THE INVENTION

It is therefore an object of the present invention to provide a droplet ejecting apparatus which is free from at least one of the above-identified problems. It is another object of the present invention to provide such a droplet ejecting apparatus which employs a piezoelectric body that can be produced at low cost, be easily polarized, and enjoy improved deformation efficiency at a certain drive voltage. These objects may be achieved according to any one of the following modes of the present invention.

(1) An apparatus for ejecting, from a nozzle communicating with a pressure chamber in which a liquid is accommodated, a droplet of the liquid by deforming a portion of a piezoelectric body and thereby changing a volume of the pressure chamber, the apparatus comprising the piezoelectric body; at least one first internal electrode which is provided in the piezoelectric body, at a first position where the first internal electrode is opposed to the pressure chamber in a first direction; at least one second internal electrode which is provided in the piezoelectric body, at a second position distant from the first position in a second direction perpendicular to the first direction; and a first polarizing electrode and a second polarizing electrode which cooperate with each other to sandwich, in the first direction, at least a first portion of the piezoelectric body that is located between the first and second internal electrodes in the second direction, the first portion of the piezoelectric body being polarized in the first direction by applying a polarizing voltage to the first and second polarizing electrodes, one of the first and second polarizing electrodes being electrically connected to one of the first and second internal electrodes, wherein when a driving voltage is applied to the first and second internal electrodes, a first electric field is produced in the first portion of the piezoelectric body, substantially in the second direction, and a second electric field is produced in a second portion of the piezoelectric body that is located between the one of the first and second polarizing electrodes and an other of the first and second internal electrodes, substantially in the first direction. When the second electric field is produced in the second portion of the piezoelectric body, the second portion is elongated in a direction substantially parallel to the direction in which the second electric field is produced, and is shrunk in a direction perpendicular to the direction of elongation, and this deformation of the second portion promotes or amplifies the deformation of the first portion of the piezoelectric body caused by the first electric field, i.e., the so-called shear deformation of the first portion.

In this droplet ejecting apparatus, when the driving voltage is applied to the first and second internal electrodes, the first electric field is produced in the first portion of the piezoelectric body located between the first and second internal electrodes, substantially in the second direction perpendicular to the first direction in which the first portion of the piezoelectric body is polarized, so that the first portion of the piezoelectric body is deformed in the shear mode, and additionally the second electric field is produced in the second portion of the piezoelectric body located between the one of the first and second polarizing electrodes and the other of the first and second internal electrodes, so that the second portion of the piezoelectric body is so deformed as to facilitate the deformation of the first portion of the same. Thus, in the droplet ejecting apparatus, the piezoelectric body can enjoy improved deformation efficiency at a given drive voltage. In addition, since the polarizing electrodes are not removed from the piezoelectric body, but are utilized to improve the deformation efficiency of the same, in contrast to a conventional apparatus in which polarizing electrodes are removed from a piezoelectric body, the piezoelectric body of the present apparatus can be manufactured with ease and at low cost.

(2) The apparatus according to the mode (1), wherein the piezoelectric body comprises a plurality of piezoelectric sheets which are stacked on each other in the first direction, wherein the apparatus comprises a plurality of the first internal electrodes which are provided at the first position such that each of the first internal electrodes is interposed between a corresponding pair of adjacent sheets out of the plurality of piezoelectric sheets, and a plurality of the second internal electrodes which are provided at the second position such that each of the second internal electrodes is interposed between a corresponding pair of adjacent sheets out of the plurality of piezoelectric sheets, and wherein the first and second polarizing electrodes cooperate with each other to sandwich, in the first direction, the plurality of piezoelectric sheets in which the first and second internal electrodes are provided.

According to this mode, the plurality of first internal electrodes and the plurality of second internal electrodes can be easily provided in the piezoelectric body, which contributes to improving the deformation efficiency of the same.

(3) The apparatus according to the mode (1), wherein one of the first and second polarizing electrodes is provided on one of opposite surfaces of the piezoelectric body that is remote from the pressure chamber in the first direction, and the other of the first and second polarizing electrodes includes an extended portion that is extended to the one surface of the piezoelectric body.

According to this mode, the two polarizing electrodes can be easily connected to each of a polarizing power source and a driving power source.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
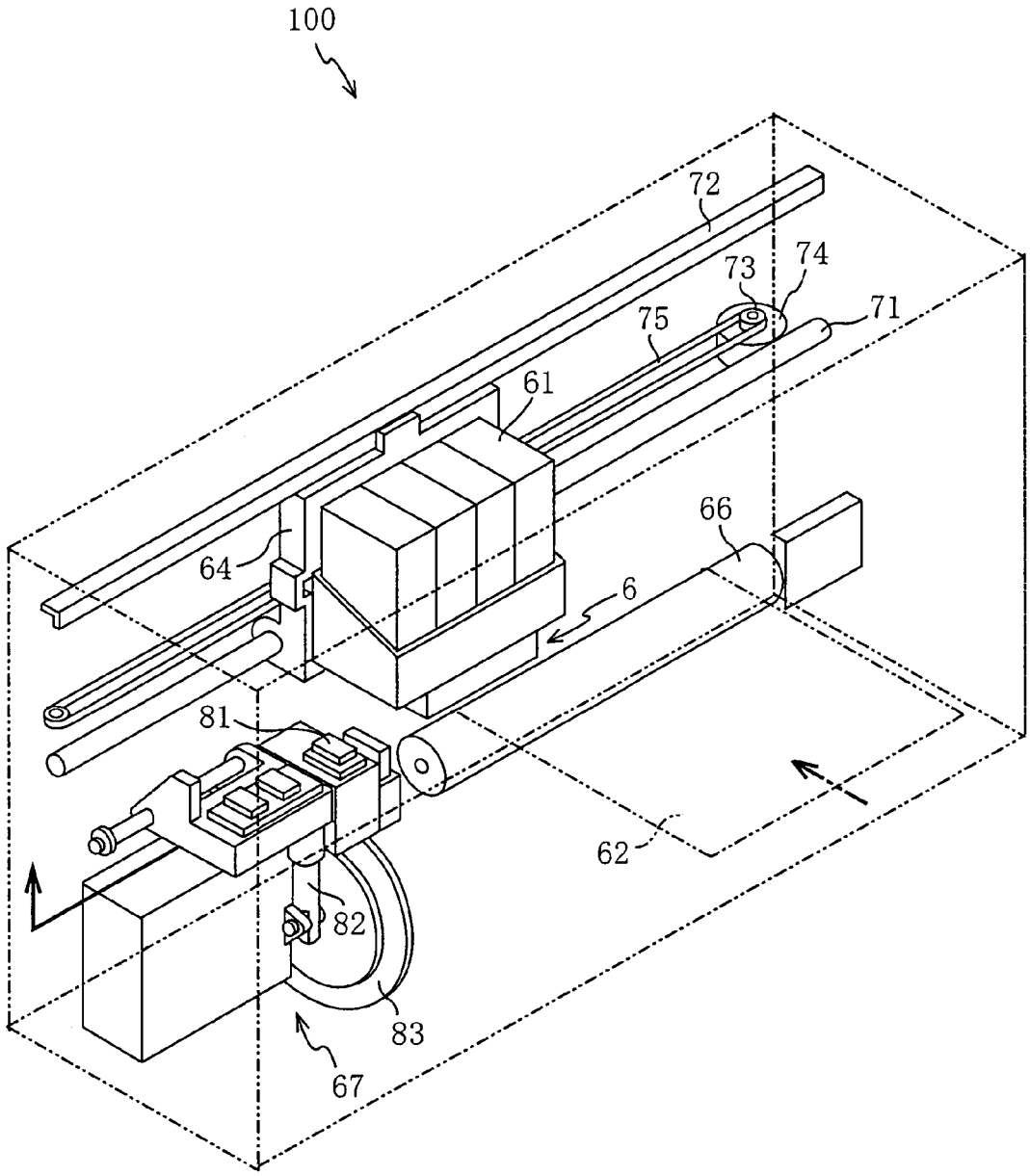
FIG. 1 is a perspective view of an ink jet recording apparatus including a piezoelectric-type ink jet recording head to which the present invention is applied.

Hereinafter, there will be described preferred embodiments of the present invention by reference to the drawings. FIG. 1 shows an ink jet recording apparatus 100 including a piezoelectric-type ink jet recording head 6 as a droplet ejecting apparatus to which the present invention is applied. First, the ink jet recording apparatus 100 will be briefly described. The piezoelectric ink jet recording head 6 is for recording characters and/or symbols on a recording medium, e.g., a sheet of paper 62, and is mounted, together with ink cartridges 61, on a carriage 64.

The carriage 64 is fixed to an endless belt 75 and, when a pulley 73 is rotated forward and backward by an electric motor 74, the carriage 64 is linearly reciprocated along a guide bar 71 and a guide plate 72. During the reciprocation of the carriage 64, droplets of ink are ejected from ink ejection nozzles 13 of the ink jet recording head 6 toward the sheet of paper 62. The paper 62 is fed from a sheet supply cassette, not shown, provided in the ink jet recording apparatus 100, to a location between the ink jet recording head 6 and a platen roller 66. After the ink jet recording head 6 records images on the paper 62, the paper 62 is discharged. A sheet feeding device and a sheet discharging device for feeding and discharging the sheet of paper 62, respectively, are not shown.

A purging device 67 is provided on one side of the platen roller 66. The purging device 67 is for removing undesirable ink remaining in the ink jet recording head 6. More specifically described, when the carriage 64 is positioned at a resetting position, a purging cap 81 of the purging device 67 covers a nozzle supporting surface of the ink jet recording head 6 so as to form an air-tight space. Then, the air-tight space is depressurized by an air pump 82 that is communicated with the purging cap 81 and operated by a cam 83. Thus, the undesirable ink remaining in the ink jet recording head 6 is removed.

Figure 2:
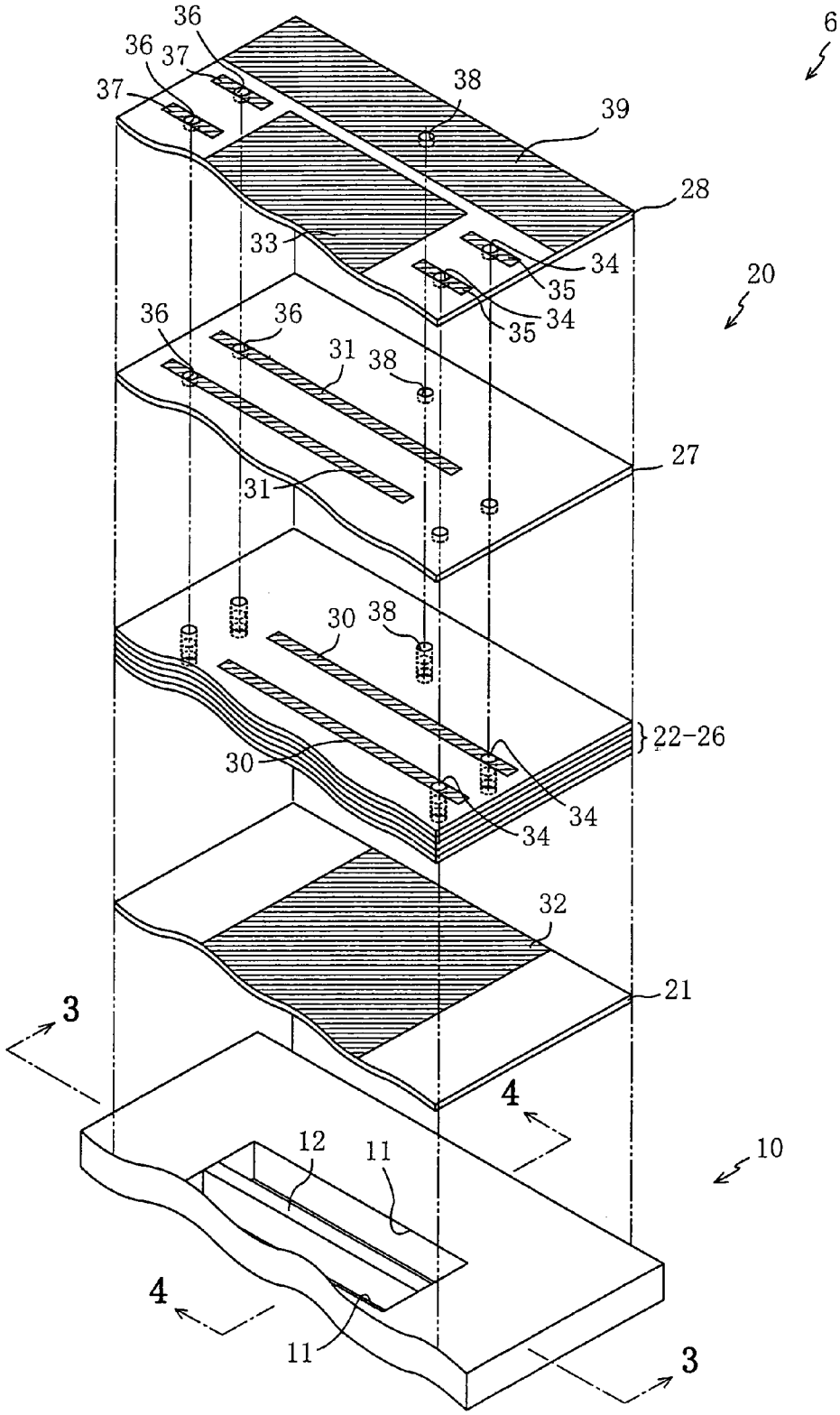
FIG. 2 is a perspective, exploded view of a sheet-stacked-type piezoelectric body of the ink jet recording apparatus that includes a plurality of piezoelectric sheets stacked on each other.
Figure 3:
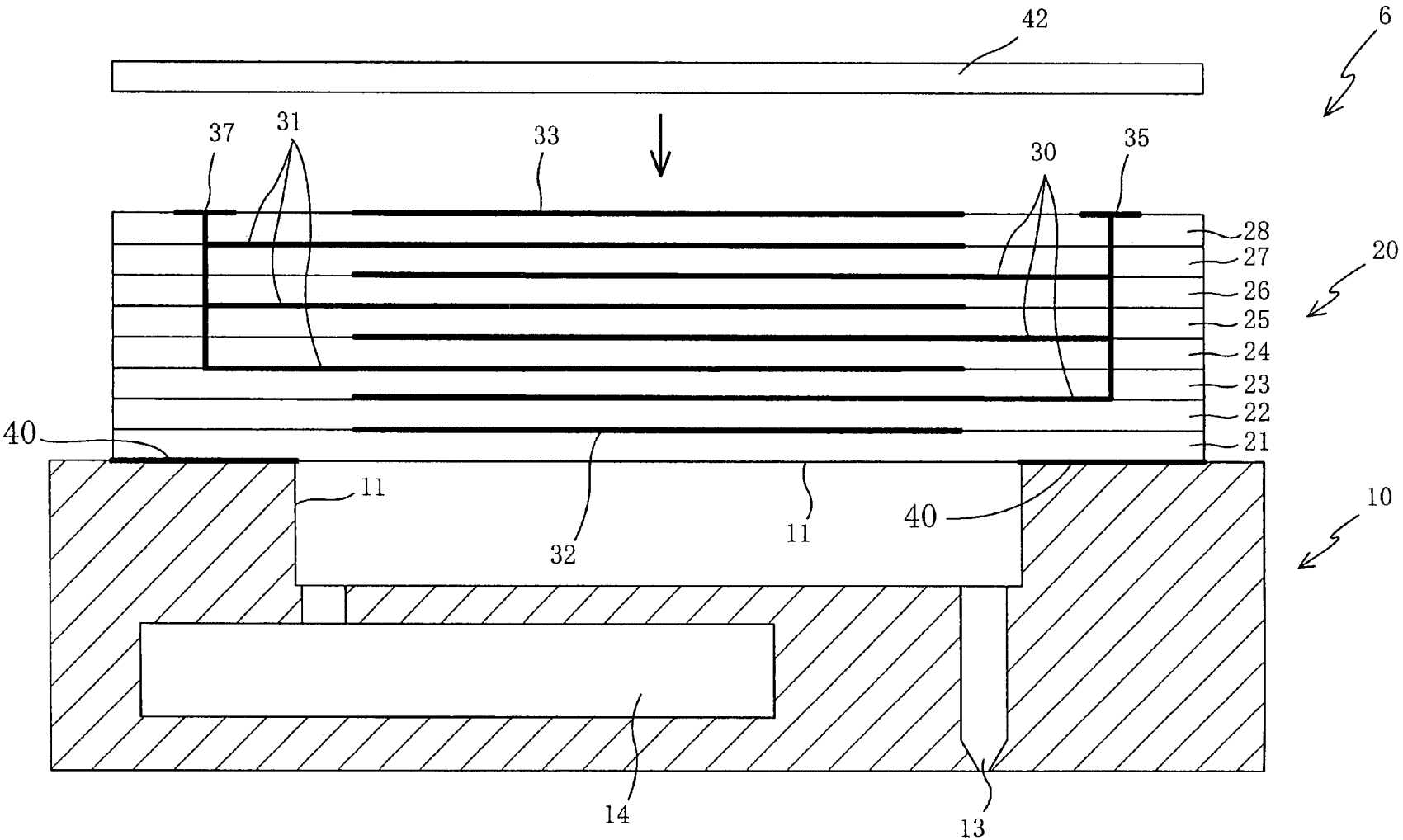
FIG. 3 is a cross-sectional view of the ink jet recording head, taken along 3—3 in FIG. 2.

Next, there will be described a construction of the piezoelectric ink jet recording head 6 by reference to FIGS. 2, 3, and 4. The ink jet recording head 6 includes a sheet-stacked-type piezoelectric body 20.

The ink jet recording head 6 additionally includes a cavity unit 10 having a plurality of elongate pressure chambers 11 each opening upward, and the stacked-type piezoelectric body 20 is fixed with an adhesive 40 to an upper surface of the cavity unit 10 in which the pressure chambers 11 open upward, so that the piezoelectric body 20 closes the respective upper openings of the pressure chambers 11.

The cavity unit 10 has, in a lower surface thereof opposed to the sheet of paper 62, a plurality of ink ejection nozzles 13 arranged in an array, and additionally has, in the upper surface thereof opposite to the lower surface, the plurality of pressure chambers 11 arranged in an array so as to communicate with the ink ejection nozzles 13, respectively. The pressure chambers 11 are separated from each other by respective partition walls 12. Each of the pressure chambers 11 is supplied with ink from a common ink manifold 14.

The stacked-type piezoelectric body 20 includes eight piezoelectric sheets each of which contains a piezoelectric ceramic material (hereinafter, simply referred to as the "piezoelectric sheets") and which are stacked on each other and are fired into an integral body. Here, for easier understanding purposes only, the eight piezoelectric sheets will be referred to as the first, second, third, fourth, fifth, sixth, seventh, and eighth piezoelectric sheets 21, 22, 23, 24, 25, 26, 27, 28 as counted upward from the cavity unit 10, as shown in FIG. 3.

Thus, the first and eighth piezoelectric sheets 21, 28 sandwich the second to seventh piezoelectric sheets 22 to 27. On each of the second, fourth, and sixth piezoelectric sheets 22, 24, 26, a plurality of elongate, rectangular first internal electrodes 30 are arranged in an array such that each of the first internal electrodes 30 is aligned with a widthwise central portion of a corresponding one of the pressure chambers 11, as shown in FIG. 4. Each first internal electrode 30 has a width smaller than that of each pressure chamber 11, and extends in a lengthwise direction of the corresponding pressure chamber 11. Thus, three first internal electrodes 30 respectively provided on the three piezoelectric sheets 22, 24, 26 are aligned with each of the pressure chambers 11 in a direction of stacking of the piezoelectric sheets 21–28, and are electrically connected to each other via an electrically conducting material filling respective through-holes 34 formed through the respective thickness of the third to eighth piezoelectric sheets 23–28, so that the three first internal electrodes 30 aligned with the each pressure chamber 11 are electrically connected to a corresponding one of a plurality of first surface electrodes 35 provided on one of widthwise opposite end portions of the eighth piezoelectric sheet 28.

Meanwhile, on each of the third, fifth, and seventh piezoelectric sheets 23, 25, 27, a plurality of elongate, rectangular second internal electrodes 31 are arranged in an array such that each of the second internal electrodes 31 is aligned with a corresponding one of the partition walls 12 and is distant from the first internal electrodes 30 in a direction parallel to the upper surface of the cavity unit 10 in which the pressure chambers 11 open upward. Thus, three second internal electrodes 31 respectively provided on the three piezoelectric sheets 23, 25, 27 are aligned with each of the partition walls 12 in the direction of stacking of the piezoelectric sheets 21–28, and are electrically connected to each other via an electrically conducting material filling respective through-holes 36 formed through the respective thickness of the fourth to eighth piezoelectric sheets 24–28, so that the three second internal electrodes 31 aligned with the each partition wall 12 are electrically connected to a corresponding one of a plurality of second surface electrodes 37 provided on the other widthwise end portion of the eighth piezoelectric sheet 28.

Thus, the three piezoelectric sheets 22, 24, 26 on each of which the first internal electrodes 30 are provided, and the three piezoelectric sheets 23, 25, 27 on each of which the second internal electrodes 31 are provided, are alternately stacked on each other to provide the stacked-type piezoelectric body 20. Since the first and second internal electrodes 30, 31 are not alternately arranged on a common piezoelectric sheet, the present stacked-type piezoelectric body 20 is free from a problem that an electric short circuit may occur between first and second internal electrodes that are alternately arranged on a common piezoelectric sheet.

Meanwhile, two belt-like polarizing electrodes 32, 33 each having a width substantially equal to a length of each pressure chamber 11 are provided on respective upper surfaces of the first and eighth piezoelectric sheets 21, 28, such that the polarizing electrodes 32, 33 extend over all the pressure chambers 11. According to the present invention, it is essentially required that the two polarizing electrodes 32, 33 be disposed at respective positions where the polarizing electrodes 32, 33 can sandwich at least respective portions of the piezoelectric sheets 22–28 that are located between the first internal electrodes 30 and the second internal electrodes 31 as seen in the direction parallel to the direction in which the pressure chambers 11 are arranged. In the present embodiment, the polarizing electrodes 32, 33 take the belt-like shape for the purpose of efficiently polarizing the piezoelectric sheets 22–28. More specifically described, the two polarizing electrodes 32, 33 are so disposed as to be able to sandwich, in the direction perpendicular to the direction in which the first and second internal electrodes 30, 31 are opposed to each other, the respective portions of the piezoelectric sheets 22–28 that are located between the first and second internal electrodes 30, 31. The first polarizing electrode 32 provided on the first piezoelectric sheet 21 is electrically connected to a third surface electrode 39 provided on a lengthwise end portion of the eighth piezoelectric sheet 28, via an electrically conductive material filling respective through-holes 38 formed through the respective thickness of the second to eighth piezoelectric sheets 22–28.

Figure 6:
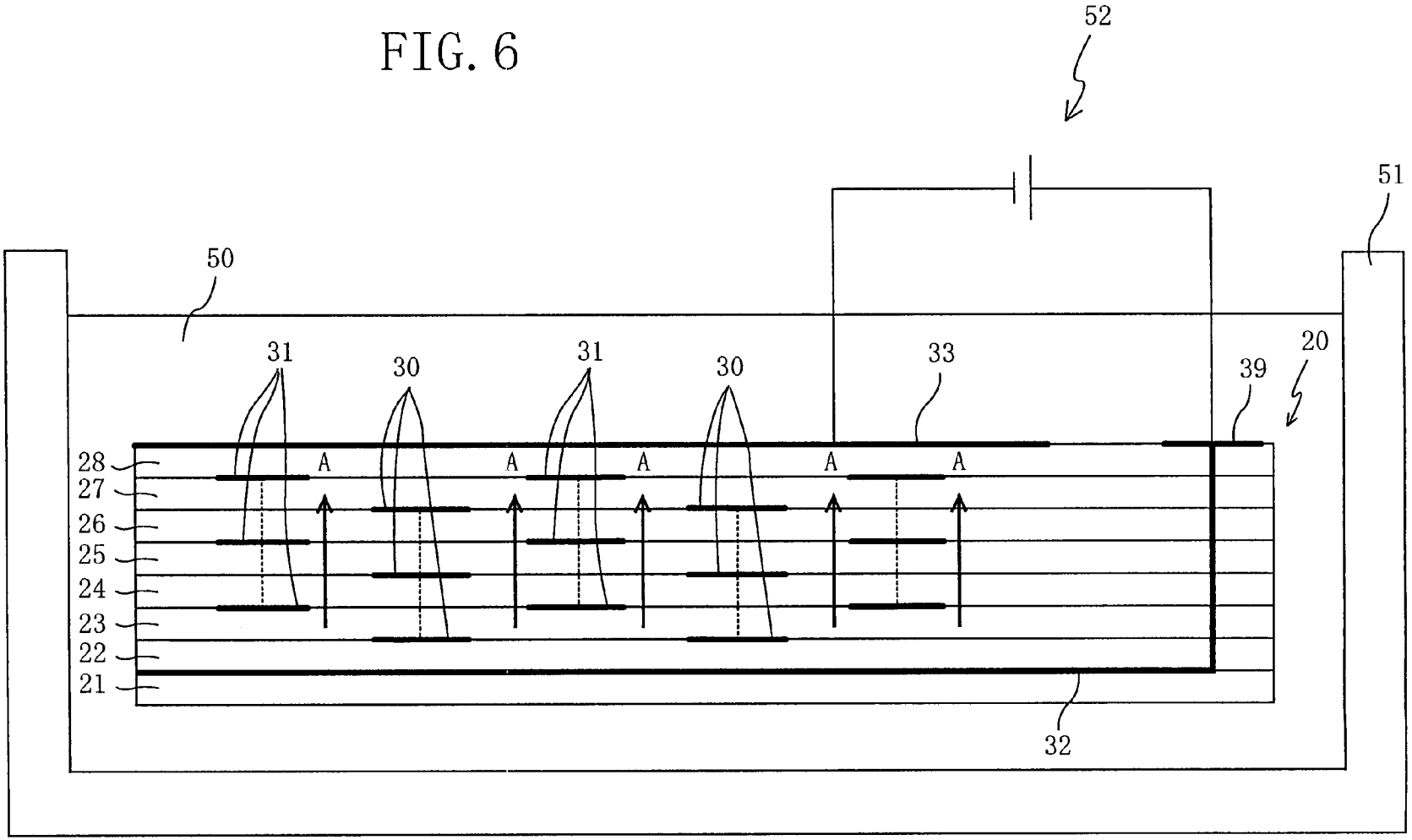
FIG. 6 is a view for explaining a polarizing step in which the stacked-type piezoelectric body is polarized in the direction of stacking of piezoelectric sheets thereof.

As shown in FIG. 6, the stacked-type piezoelectric body 20 is polarized in such a manner in which, first, the piezoelectric body 20 is immersed in an electrically insulating oil 50, such as silicone oil, accommodated in an oil bath 51 and, then, a polarizing power source 52 is operated to apply a polarizing high voltage to the two polarizing electrodes 32, 33 so as to polarize the piezoelectric body 20 in a direction indicated by arrow "A", i.e., in the direction of stacking of the piezoelectric sheets 22–28. Thus, all the respective portions of the piezoelectric sheets 22–28 that are located between all the first internal electrodes 30 and all the second internal electrodes 31 in the direction of arrangement of the pressure chambers 11, are polarized in the direction A perpendicular to the direction in which the first and second internal electrodes 30, 31 are opposed to each other. In addition, all respective portions of the piezoelectric sheets 22–28 that are aligned with all the first and second internal electrodes 30 are polarized in the direction A by the polarizing electrodes 32, 33.

The stacked-type piezoelectric body 20 constructed as described above is fixed to the cavity unit 10 such that the lower surface of the first piezoelectric sheet 21 is adhered with the adhesive 40 to the upper surface of the cavity unit 10 and such that each of the first internal electrodes 30 is aligned with a widthwise central portion of a corresponding one of the pressure chambers 11. On the eighth piezoelectric sheet 28, there is provided a flexible flat cable 42 having a printed wiring pattern that electrically connects the second polarizing electrode 33 and the first to third surface electrodes 35, 36, 39 provided on the eighth piezoelectric sheet 28, to a drive power source 41 provided in the ink jet recording apparatus 100.

Figure 4:
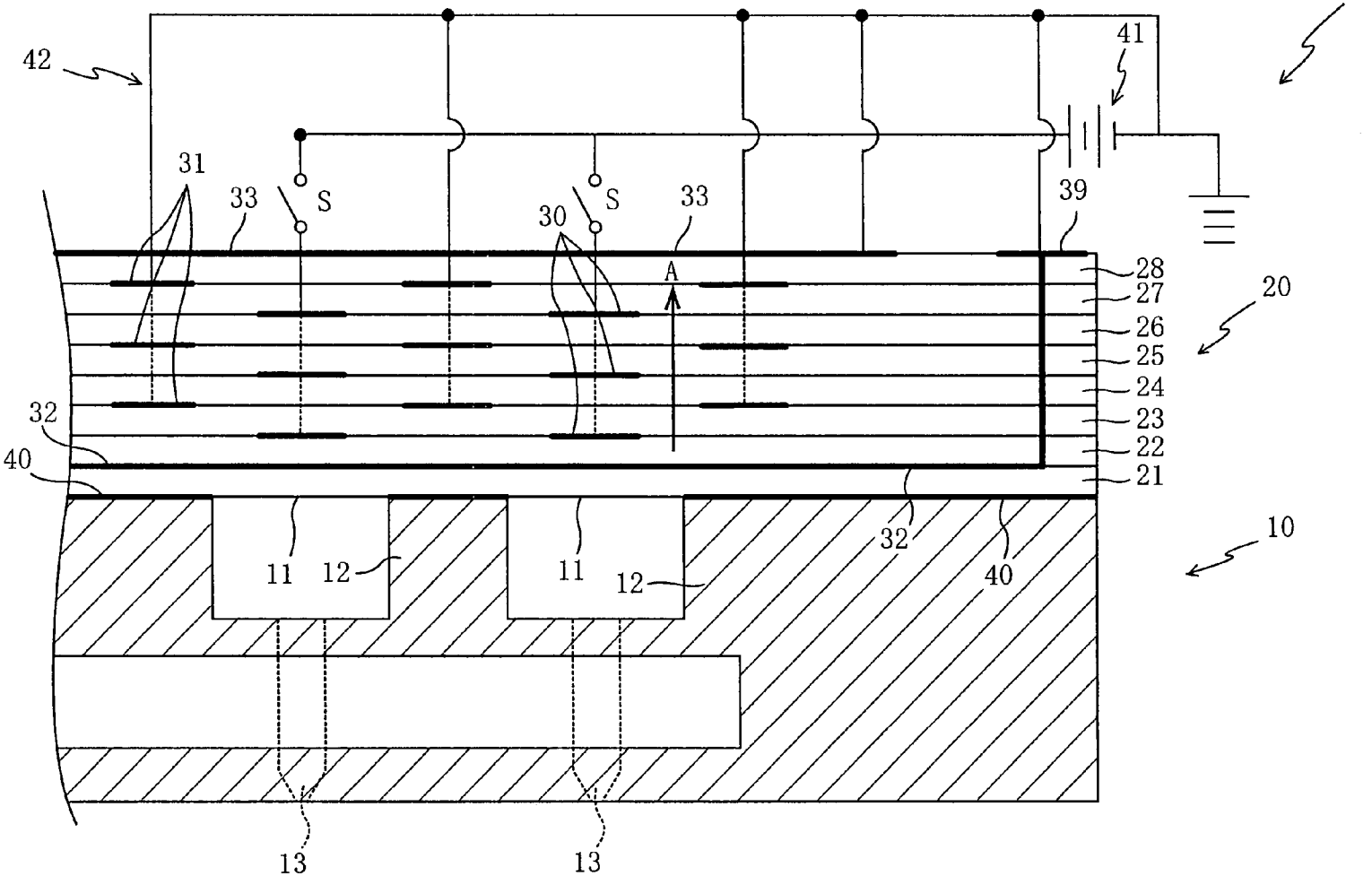
FIG. 4 is a cross-sectional view of the ink jet recording head, taken along 4—4 in FIG. 2.

FIG. 4 diametrically shows the printed wiring pattern of the flexible flat cable 42. More specifically described, each group of first internal electrodes 30 aligned with each other in the direction of stacking of piezoelectric sheets 21–28 is electrically connected via a switch, S, to a positive terminal of the drive power source 41, and each group of second internal electrodes 31 aligned with each other in the direction of stacking of piezoelectric sheets 21–28 is electrically connected to a ground terminal of the power source 41. The first and second polarizing electrodes 32, 33 are connected to the ground terminal of the power source 41. However, the first polarizing electrode 32 may not be connected to the ground terminal.

Figure 5:
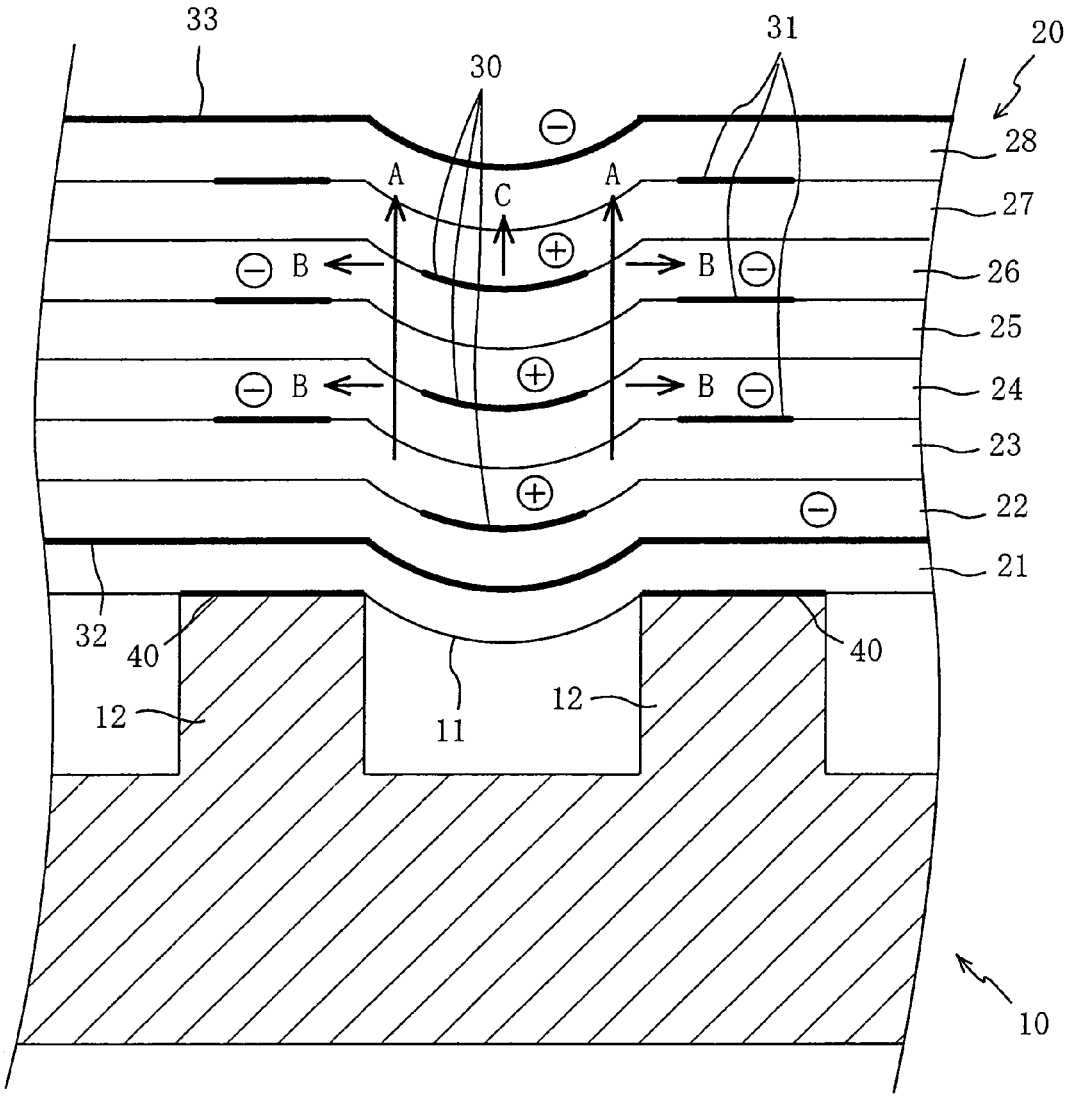
FIG. 5 is an enlarged, cross-sectional view showing a state in which a certain drive voltage is applied to first and second internal electrodes provided in the stacked-type piezoelectric body.

Next, there will be described the operation of the piezoelectric ink jet recording head 6 constructed as described above, by reference to FIG. 5. FIG. 5 shows a state of the stacked-type piezoelectric body 20 in which the drive power source 41 is applying an appropriate drive voltage to the first and second internal electrodes 30, 31.

When a controller, not shown, of the ink jet recording apparatus 100 operates an arbitrary one of the switches S, based on printing data, the drive voltage is applied via the thus operated switch S to the corresponding group of first internal electrodes 30. Since the first internal electrodes 30 of that group are connected to the positive terminal of the drive power source 41 and all groups of second internal electrodes 31 are connected to the ground terminal of the power source 41, an electric field is produced between the first and second internal electrodes 30, 31, in a direction, indicated at arrow "B", substantially perpendicular to the direction of polarization of the piezoelectric body 20, indicated at arrow "A". Consequently respective portions of the second to seventh piezoelectric sheets 22–27 that are located on one of opposite sides of the group of first internal electrodes 30, and respective portions of the second to seventh piezoelectric sheets 22–27 that are located on the other side of the group of first internal electrodes 30 are deformed in the so-called "shear" mode, symmetrically with respect to the group of first internal electrodes 30, and accordingly a portion of the stacked-type piezoelectric body 20 that includes the group of first internal electrodes 30 is moved into the corresponding pressure chamber 11.

In addition, since the second or upper polarizing electrode 33 is connected to the ground terminal of the drive power source 41, another electric field is produced between the first internal electrodes 30 and the upper polarizing electrode 33, in a direction, indicated at arrow "C", parallel to the direction "A" of polarization of the seventh and eighth piezoelectric sheets 27, 28. Consequently the seventh and eighth piezoelectric sheets 27, 28 are elongated in the direction of thickness thereof and shrunk in a surface direction parallel to the upper surface of the eighth sheet 28, i.e., perpendicular to the direction of elongation.

Owing to the elongation of the seventh and eighth piezoelectric sheets 27, 28 in the direction of thickness thereof, the portion of the stacked-type piezoelectric body 20 that includes the group of first internal electrodes 30 is pushed toward the pressure chamber 11; and owing to the shrinkage of the seventh and eighth piezoelectric sheets 27, 28 in the surface direction, a so-called "bimetallic" action occurs between those sheets 27, 28 and the sixth sheet 26 adjacent the same 27, 28. Thus, the entirety of the above-indicated portion of the piezoelectric body 20 is curved or projected into the pressure chamber 11. That is, the above-indicated portion of the piezoelectric body 20 that is moved into the pressure chamber 11 owing to the shear-mode deformation thereof, is further moved owing to the deformation of the seventh and eighth piezoelectric sheets 27, 28. This means an improved rate or efficiency of deformation of the stacked-type piezoelectric body 20 at a given drive voltage.

When the stacked-type piezoelectric body 20 is deformed, the volume of the pressure chamber 11 is decreased, and accordingly a droplet of ink is ejected from the pressure chamber 11 via the corresponding ejection nozzle 13 toward the sheet of paper 62 and an image such as a character or a symbol is recorded on the paper 62.

In the present embodiment, the stacked-type piezoelectric body 20 can be deformed not only in the shear mode but also be more largely deformed by utilizing the polarizing, external electrodes 32, 33 that have been removed from the conventional devices. Thus, the ink jet recording head 6 can enjoy low price and high ink-ejection efficiency. In addition, in the present embodiment, since the first or lower polarizing electrode 32 provided between the first and second internal electrodes 30, 31 and the cavity unit 10 is grounded, the electric current does not leak to the ink accommodated in the cavity unit 10 when the drive voltage is applied to the first and second internal electrodes 30, 31. Thus, the ink can be stably ejected from the cavity unit 10 without being electrically influenced. Moreover, since the wiring pattern of the flexible flat cable 42, connected to the polarizing electrodes 32, 33, is disconnectable from the drive power source 41, a high voltage can be applied to the polarizing electrodes 32, 33 so as to re-polarize the piezoelectric body 20 after the ink jet recording head 6 is used for a certain period of time.

While the present invention has been described in its preferred embodiment, the invention is by no means limited to the details of the described embodiment and may otherwise be embodied.

For example, in the first embodiment shown in FIG. 5, the stacked-type piezoelectric body 20 is polarized in the same direction as the direction of stacking of piezoelectric sheets 21–28, more specifically described, in the direction from the first sheet 21 located on the side of the cavity unit 10, toward the eighth sheet 28. However, the stacked-type piezoelectric body 20 may be polarized in an opposite direction, i.e., in a direction from the eighth sheet 28 toward the first sheet 21 (see the fourth embodiment shown in FIG. 9). In the latter case, the piezoelectric body 20 can be deformed or curved in a direction to increase the volume of each pressure chamber 11, and accordingly the piezoelectric body 20 can be used in a so-called "fill-before-fire" manner in which each chamber 11 is filled with ink before ejection.

Figure 7:
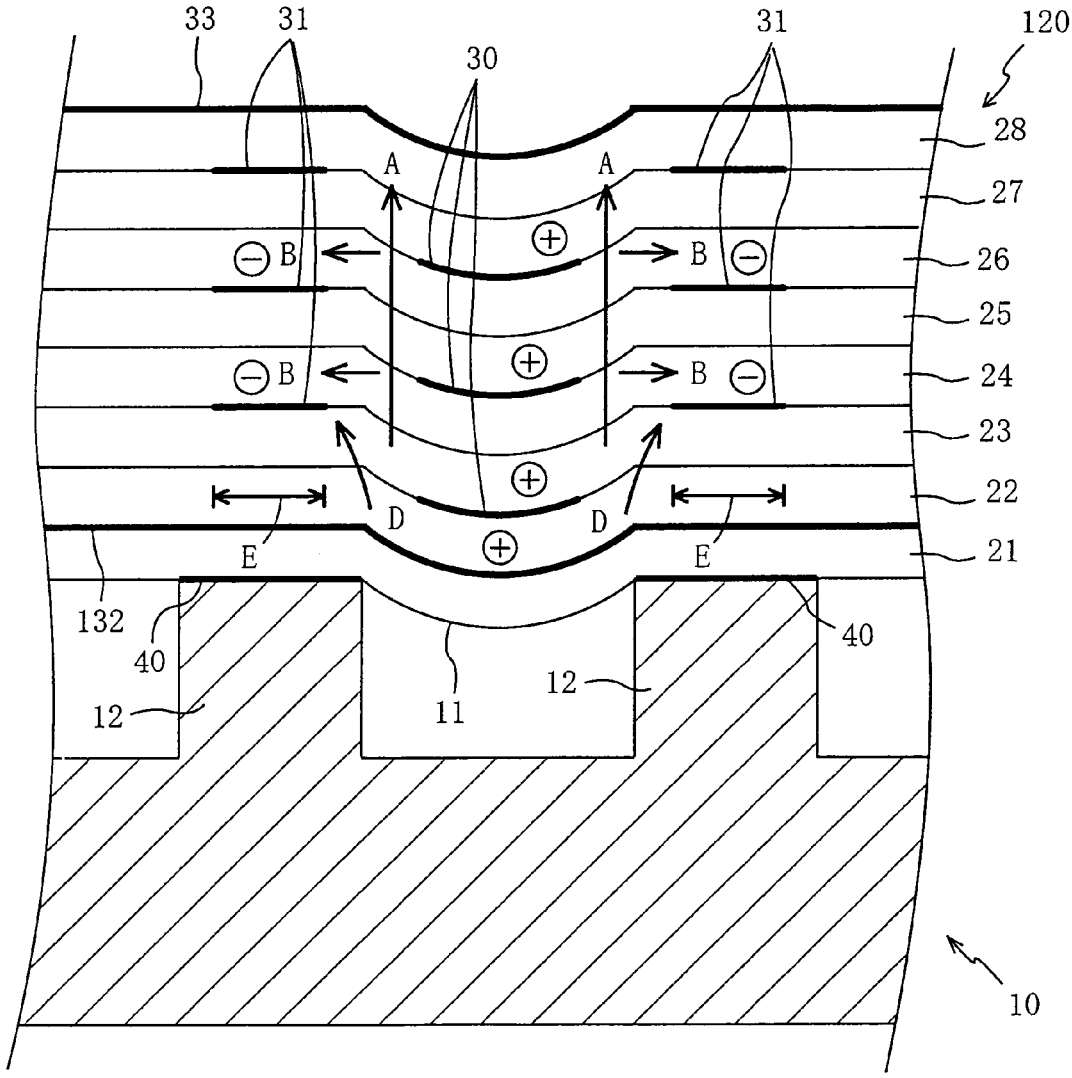
FIG. 7 is an enlarged, cross-sectional view corresponding to FIG. 5, showing a state in which a certain drive voltage is applied to first and second internal electrodes provided in another stacked-type piezoelectric body of another piezoelectric-type ink jet recording head as a second embodiment of the present invention.

FIG. 7 shows a second embodiment of the present invention that also relates to an ink jet recording head that, however, employs a stacked-type piezoelectric body 120 in place of the stacked-type piezoelectric body 20 employed in the first embodiment shown in FIG. 5. The same reference numerals as used in the first embodiment are used to designate the corresponding elements or parts of the second embodiment, and the description thereof is omitted.

The stacked-type piezoelectric body 120 includes a first polarizing electrode 132 that is connected to the positive terminal of the drive power source 41, and is electrically connected to the first internal electrodes 30. When the drive power source 41 applies the drive voltage to the first and second internal electrodes 30, 31, there are generated not only the electric field, indicated at arrow B, between the first and second internal electrodes 30, 31, in the directions substantially perpendicular to the direction A of polarization of the piezoelectric body 120, but also an electric field, indicated at D, between the first polarizing electrode 132 and the second internal electrodes 31. In the vicinity of the first polarizing electrode 132, the electric field D is generated in directions substantially parallel to the direction A of polarization. Thus, at least two portions of the piezoelectric body 120 that are located between the group of first internal electrodes 30 and the two groups of second internal electrodes 31 are deformed in the shear mode caused by the electric field B, and additionally, at least two portions of the second and third piezoelectric sheets 22, 23 that are located between the first polarizing electrode 132 and the two groups of second internal electrodes 31 are elongated in directions substantially parallel to the direction A of polarization and are shrunk in directions perpendicular to the direction of elongation. Thus, the shear-mode deformation of the piezoelectric body 120, caused by the electric field B, is facilitated by the elongation and shrinkage of the second and third piezoelectric sheets 22, 23, caused by the electric field D. Thus, the above-indicated two portions of the piezoelectric body 120 are moved into the pressure chamber 11, so as to decrease the volume of the chamber 11 and thereby eject a droplet of ink from the nozzle 13 communicating with the chamber 11. The second polarizing electrode 33 may, or may not, be connected to the ground terminal of the drive power source 41.

In the second embodiment, preferably, respective portions of the first polarizing electrode 132 that are aligned with areas, E, in which the second internal electrodes 31 are provided, are removed, in advance, so as not to adversely restrict the elongation and shrinkage of the second and third piezoelectric sheets 22, 23.

Figure 8:
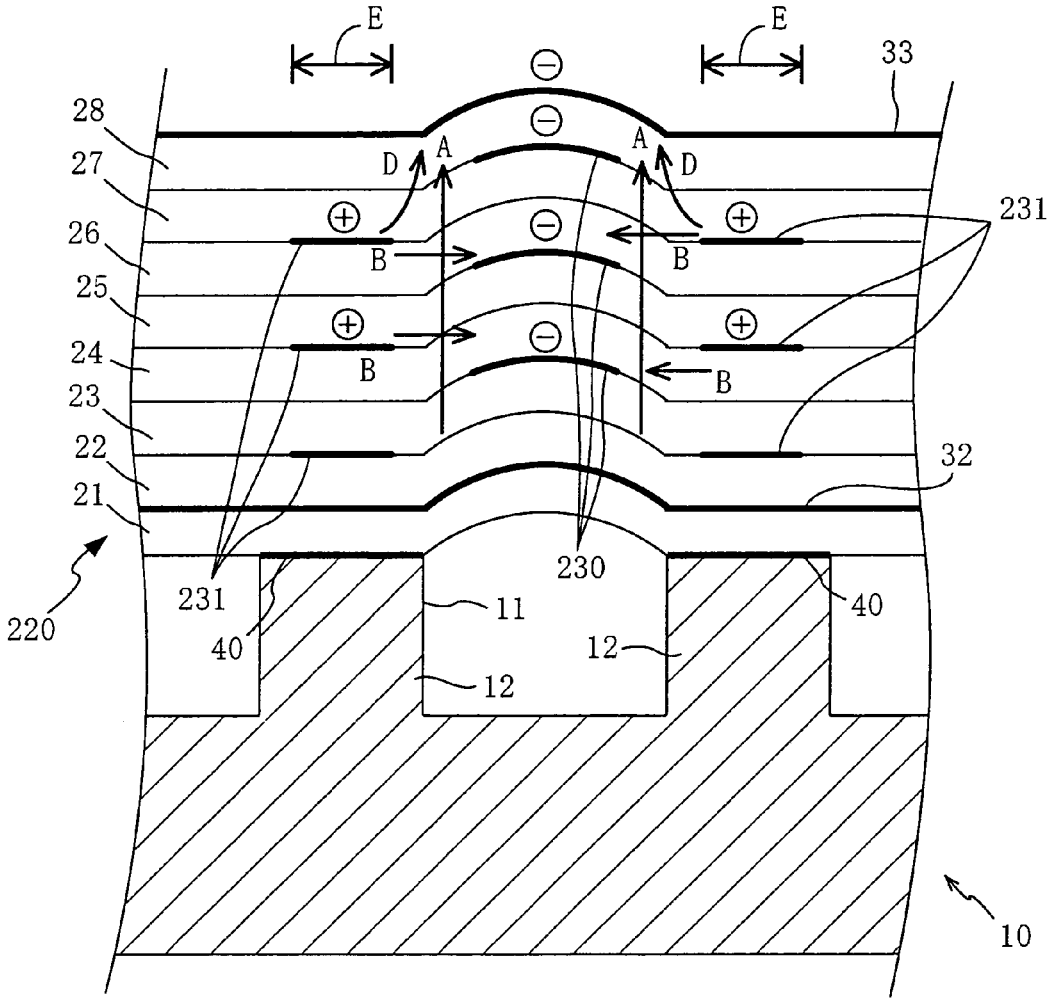
FIG. 8 is an enlarged, cross-sectional view corresponding to FIG. 5, showing a state in which a certain drive voltage is applied to first and second internal electrodes provided in yet another stacked-type piezoelectric body of yet another piezoelectric-type ink jet recording head as a third embodiment of the present invention.

FIG. 8 shows a third embodiment of the present invention that also relates to an ink jet recording head that, however, employs a stacked-type piezoelectric body 220 in place of the stacked-type piezoelectric body 20 or 120 employed in the first or second embodiments. The stacked-type piezoelectric body 220 includes first internal electrodes 230 that are connected to the ground terminal of the drive power source 41, and second internal terminals 231 that are connected to the positive terminal of the same 41. Thus, the second polarizing electrode 33 is electrically connected to the first internal electrodes 230. When the drive power source 41 applies the drive voltage to the first and second internal electrodes 230, 231, there are generated not only an electric field, indicated at arrow B, between the first and second internal electrodes 230, 231, in directions substantially perpendicular to the direction A of polarization of the piezoelectric body 220, but also an electric field, indicated at D, between the second polarizing electrode 33 and the second internal electrodes 231. In the vicinity of the second polarizing electrode 33, the electric field D is generated in directions substantially parallel to the direction A of polarization. Thus, at least two portions of the piezoelectric body 220 that are located between the group of first internal electrodes 230 and the two groups of second internal electrodes 231 are deformed in the shear mode caused by the electric field B and, additionally, at least two portions of the seventh and eighth piezoelectric sheets 27, 28 that are located between the second polarizing electrode 33 and the two groups of second internal electrodes 231 are elongated in directions substantially parallel to the direction A of polarization and are shrunk in directions perpendicular to the direction of elongation. Thus, the shear-mode deformation of the piezoelectric body 220, caused by the electric field B, is facilitated by the elongation and shrinkage of the seventh and eighth piezoelectric sheets 27, 28, caused by the electric field D. Thus, the above-indicated two portions of the piezoelectric body 220 are moved away from the pressure chamber 11, so as to increase the volume of the chamber 11, thereby drawing a certain amount of ink into the chamber 11, and subsequently are returned to their initial position so as to eject a droplet of ink from the nozzle 13 communicating with the chamber 11. This is the so-called "fill-before-fire" manner. The first polarizing electrode 32 may, or may not, be connected to the positive terminal of the drive power source 41.

In the third embodiment, preferably, respective portions of the second polarizing electrode 33 that are aligned with areas, E, in which the second internal electrodes 231 are provided, are removed, in advance, so as not to adversely restrict the elongation and shrinkage of the seventh and eighth piezoelectric sheets 27, 28.

Figure 9:
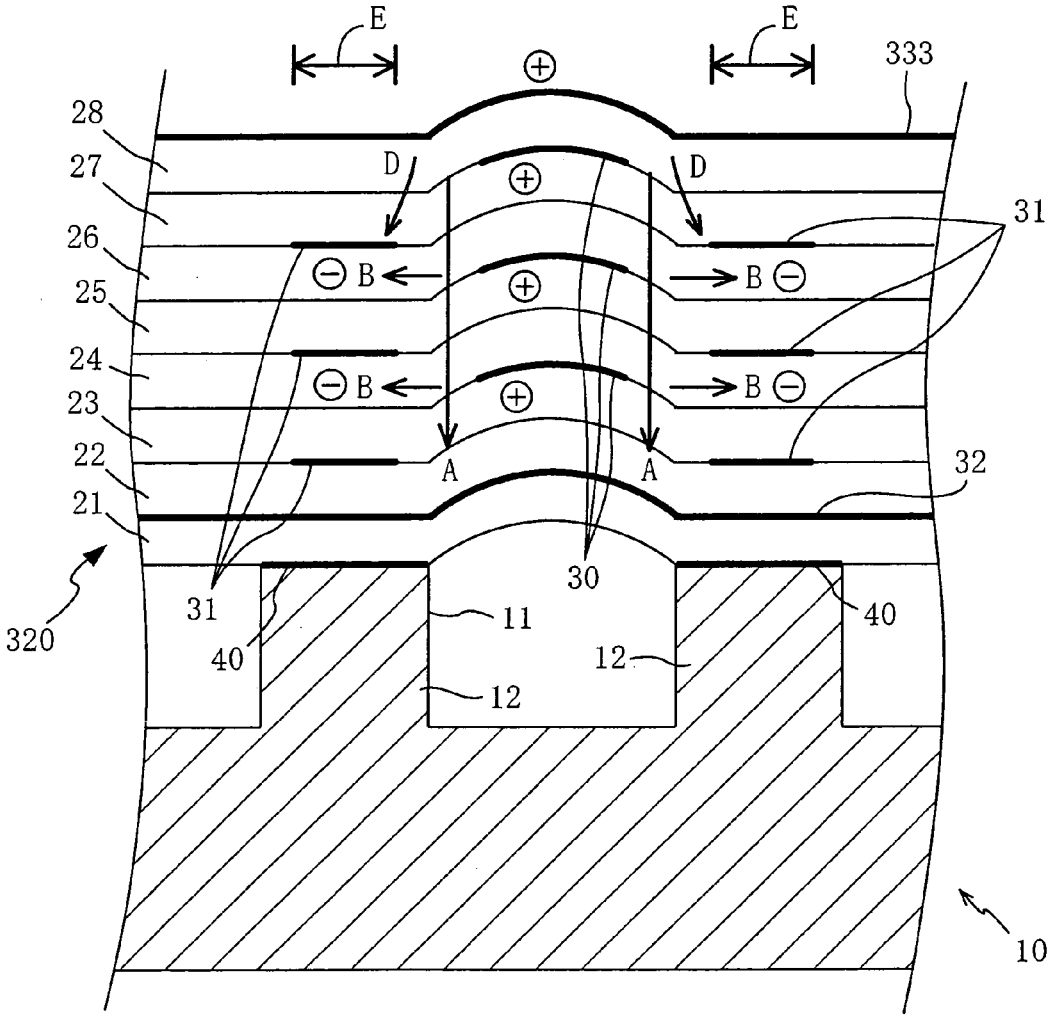
FIG. 9 is an enlarged, cross-sectional view corresponding to FIG. 5, showing a state in which a certain drive voltage is applied to first and second internal electrodes provided in another stacked-type piezoelectric body of another ink piezoelectric-type ink jet recording head as a fourth embodiment of the present invention.

FIG. 9 shows a fourth embodiment of the present invention that also relates to an ink jet recording head that, however, employs a stacked-type piezoelectric body 320 in place of the stacked-type piezoelectric body 20, 120, 220 employed in the first, second, or third embodiments. The stacked-type piezoelectric body 320 is polarized in a direction, A, that is opposite to the direction A used in the first to third embodiments, with respect to the pressure chamber 11. The piezoelectric body 320 includes a second polarizing terminal 333 that is connected to the positive terminal of the drive power source 41. Thus, the second polarizing electrode 333 is electrically connected to the first internal electrodes 30. When the drive power source 41 applies the drive voltage to the first and second internal electrodes 30, 31, there are generated not only the electric field, indicated at arrow B, between the first and second internal electrodes 30, 31, in directions substantially perpendicular to the direction A of polarization of the piezoelectric body 320, but also an electric field, indicated at D, between the second polarizing electrode 333 and the second internal electrodes 31. In the vicinity of the second polarizing electrode 333, the electric field D is generated in directions substantially parallel to the direction A of polarization. Thus, at least two portions of the piezoelectric body 320 that are located between the group of first internal electrodes 30 and the two groups of second internal electrodes 31 are deformed in the shear mode caused by the electric field B and, additionally, at least two portions of the seventh and eighth piezoelectric sheets 27, 28 that are located between the second polarizing electrode 333 and the two groups of second internal electrodes 31 are elongated in directions substantially parallel to the direction A of polarization and are shrunk in directions perpendicular to the direction of elongation. Thus, the shear-mode deformation of the piezoelectric body 320, caused by the electric field B, is facilitated by the elongation and shrinkage of the seventh and eighth piezoelectric sheets 27, 28, caused by the electric field D. Thus, the above-indicated two portions of the piezoelectric body 320 are moved away from the pressure chamber 11, so as to increase the volume of the chamber 11 and eject a droplet of ink from the nozzle 13 in the "fill-before-fire" manner. The first polarizing electrode 32 may, or may not, be connected to the ground terminal of the drive power source 41.

In the fourth embodiment, preferably, respective portions of the second polarizing electrode 333 that are aligned with areas, E, in which the second internal electrodes 31 are provided, are removed, in advance, so as not to adversely restrict the elongation and shrinkage of the seventh and eighth piezoelectric sheets 27, 28.

It is to be understood that the present invention may be embodied with other changes and improvements that may occur to a person skilled in the art, without departing from the spirit and scope of the invention defined in the appended claims.

What is claimed is:

1. An apparatus for ejecting, from a nozzle communicating with a pressure chamber in which a liquid is accommodated, a droplet of the liquid by deforming a portion of a piezoelectric body and thereby changing a volume of the pressure chamber, the apparatus comprising:

the piezoelectric body;

at least one first internal electrode which is provided in the piezoelectric body, at first position where the first internal electrode is opposed to the pressure chamber in a first direction;

at least one second internal electrode which is provided in the piezoelectric body, at a second position distant from the first position in a second direction perpendicular to the first direction; and a first polarizing electrode and a second polarizing electrode which cooperate with each other to sandwich, in the first direction, at least a first portion of the piezoelectric body that is located between the first and second internal electrodes in the second direction, the first portion of the piezoelectric body being polarized in the first direction by applying a polarizing voltage to the first and second polarizing electrodes, one of the first and second polarizing electrodes being conductively connected to one of the first and second internal electrodes, wherein when a driving voltage is applied to the first and second internal electrodes, a first electric field is produced in the first portion of the piezoelectric body, substantially in the second direction, and a second electric field is produced in a second portion of the piezoelectric body that is located between said one of the first and second polarizing electrodes and the other of the first and second internal electrodes, substantially in the first direction.

2. The apparatus according to claim 1, wherein the piezoelectric body comprises a plurality of piezoelectric sheets which are stacked on each other in the first direction, wherein the apparatus comprises a plurality of said first internal electrodes which are provided at the first position such that each of the first internal electrodes is interposed between a corresponding pair of adjacent sheets out of the plurality of piezoelectric sheets, and a plurality of said second internal electrodes which are provided at the second position such that each of the second internal electrodes is interposed between a corresponding pair of adjacent sheets out of the plurality of piezoelectric sheets, and wherein the first and second polarizing electrodes cooperate with each other to sandwich, in the first direction, the plurality of piezoelectric sheets in which the first and second internal electrodes are provided.

3. The apparatus according to claim 2, further comprising:

a first electrically conductive material that fills at least one first through-hole formed in at least one first sheet out of the plurality of piezoelectric sheets that is sandwiched by the plurality of first internal electrodes, and thereby electrically connects the first internal electrodes to each other; and a second electrically conductive material that fills at least one second through-hole formed in at least one second sheet out of the plurality of piezoelectric sheets that is sandwiched by the plurality of second internal electrodes, and thereby electrically connects the second internal electrodes to each other.

4. The apparatus according to claim 1, wherein one of the first and second polarizing electrodes is provided on one of opposite surfaces of the piezoelectric body that is remote from the pressure chamber in the first direction, and the other of the first and second polarizing electrodes includes an extended portion that is extended to said one surface of the piezoelectric body.

5. The apparatus according to claim 1, wherein said one of the first and second polarizing electrodes is electrically connected to the second internal electrode, and wherein when the driving voltage is applied to the first and second internal electrodes, the second electric field is produced, in the first direction in which the first portion of the piezoelectric body is polarized, in the second portion of the piezoelectric body that is located between said one of the first and second polarizing electrodes and the first internal electrode, so that the second portion is so deformed as to facilitate deformation of the first portion of the piezoelectric body caused by the first electric field.

6. The apparatus according to claim 1, wherein the apparatus comprises a group of said first internal electrodes which are provided at the first position, and two groups of said second internal electrodes which are provided on opposite sides of the group of first internal electrodes, respectively, that are opposite to each other in the second direction, and wherein when the driving voltage is applied to the first and second internal electrodes, the first electric field is produced, substantially in the second direction, in each of two said first portions of the piezoelectric body that is located between the group of first internal electrodes and a corresponding one of the two groups of second internal electrodes.

7. The apparatus according to claim 6, wherein when the driving voltage is applied to the first and second internal electrodes, the two first portions of the piezoelectric body are deformed symmetrically with each other, with respect to the group of first internal electrodes.

8. The apparatus according to claim 1, wherein the piezoelectric body comprises at least five piezoelectric sheets stacked on each other in the first direction, and wherein the apparatus comprises at least two said first internal electrodes and at least two said second internal electrodes which are interposed in said at least five piezoelectric sheets, such that said at least two first internal electrodes are alternate with said at least two second internal electrodes in the first direction.

9. The apparatus according to claim 1, wherein when the driving voltage is applied to the first and second internal electrodes, the first portion of the piezoelectric body located between the first and second internal electrodes is deformed into the pressure chamber so as to decrease the volume of the pressure chamber, and the second portion of the piezoelectric body located between said one of the first and second polarizing electrodes and said other of the first and second internal electrodes is so deformed as to facilitate the deformation of the first portion into the pressure chamber.

10. The apparatus according to claim 1, wherein the apparatus ejects, from each of a plurality of nozzles which are arranged in the second direction and communicate with a plurality of pressure chambers, respectively, which are arranged in the second direction and in each of which the liquid is accommodated, a droplet of the liquid by deforming a corresponding one of a plurality of portions of the piezoelectric body that are adjacent the plurality of pressure chambers, respectively, and thereby changing a volume of a corresponding one of the plurality of pressure chambers, wherein the apparatus comprises a plurality of said first internal electrodes and a plurality of said second internal electrodes each of which is remote from a corresponding one of the plurality of first internal electrodes in the second direction, and wherein the first and second polarizing electrodes cooperate with each other to sandwich, in the first direction, at least a plurality of said first portions of the piezoelectric body each of which is located between a corresponding one of the plurality of first internal electrodes and a corresponding one of the plurality of second internal electrodes in the second direction.

11. The apparatus according to claim 10, further comprising a cavity unit having the plurality of pressure chambers, and a plurality of partition walls which separate the pressure chambers from each other, wherein each of the first internal electrodes is opposed to a substantially middle portion of a corresponding one of the pressure chambers, and each of the second internal electrodes is opposed to a corresponding one of the partition walls.

12. The apparatus according to claim 10, wherein the first and second polarizing electrodes extend, in the second direction, over each of the plurality of pressure chambers.

13. The apparatus according to claim 1, further comprising a cavity unit having the pressure chamber which opens in a surface of the cavity unit, wherein the piezoelectric body is fixed to said surface of the cavity unit to close the pressure chamber opening in said surface.

14. The apparatus according to claim 1, wherein an ink as the liquid is accommodated in the pressure chamber, and the apparatus ejects, as the droplet of the liquid, a droplet of the ink from the nozzle communicating with the pressure chamber.

15. The apparatus according to claim 1, wherein said one of the first and second polarizing electrodes is electrically connected to the first internal electrode, and wherein when the driving voltage is applied to the first and second internal electrodes, the second electric field is produced, substantially in the first direction in which the first portion of the piezoelectric body is polarized, in the second portion of the piezoelectric body that is located between said one of the first and second polarizing electrodes and the second internal electrode, so that the second portion is so deformed as to facilitate deformation of the first portion of the piezoelectric body caused by the first electric field.

16. The apparatus according to claim 1, wherein when the driving voltage is applied to the first and second internal electrodes, the first potion of the piezoelectric body located between the first and second internal electrodes is deformed away from the pressure chamber so as to increase the volume of the pressure chamber, and the second portion of the piezoelectric body located between said one of the first and second polarizing electrodes and said other of the first and second internal electrodes is so deformed as to facilitate the deformation of the first portion away from the pressure chamber.

17. An ink jet recording apparatus, comprising:

an ink jet recording head including a pressure chamber in which an ink is accommodated, a nozzle which communicates with the pressure chamber, a piezoelectric body which is deformed to change a volume of the pressure chamber and thereby eject a droplet of the ink from the nozzle, at least one first internal electrode which is provided in the piezoelectric body, at a first position where the first internal electrode is opposed to the pressure chamber in a first direction, at least one second internal electrode which is provided in the piezoelectric body, at a second position distant from the first position in a second direction perpendicular to the first direction, and a first polarizing electrode and a second polarizing electrode which cooperate with each other to sandwich, in the first direction, at least a first portion of the piezoelectric body that is located between the first and second internal electrodes in the second direction;

an ink supply source which supplies the ink to the pressure chamber of the ink jet recording head; and a carriage which supports at least the ink jet recording head and which is movable relative to a recording medium so that the ink jet recording head ejects, from the nozzle communicating with the pressure chamber, the droplet of the ink toward the recording medium to record an image on the medium, wherein the first portion of the piezoelectric body is polarized in the first direction by applying a polarizing voltage to the first and second polarizing electrodes, wherein one of the first and second polarizing electrodes is conductively connected to one of the first and second internal electrodes, wherein when a driving voltage is applied to the first and second internal electrodes, a first electric field is produced in the first portion of the piezoelectric body, substantially in the second direction, and a second electric field is produced in a second portion of the piezoelectric body that is located between said one of the first and second polarizing electrodes and the other of the first and second internal electrodes, substantially in the first direction.

* * * * *